US008773037B2

(12) United States Patent
Srimuang

(10) Patent No.: US 8,773,037 B2
(45) Date of Patent: Jul. 8, 2014

(54) BALLAST CONFIGURED TO COMPENSATE FOR LAMP CHARACTERISTIC CHANGES

(75) Inventor: Paul Srimuang, San Diego, CA (US)

(73) Assignee: Empower Electronics, Inc., San Diego, CA (US)

( * ) Notice: Subject to any disclaimer, the term of this patent is extended or adjusted under 35 U.S.C. 154(b) by 778 days.

(21) Appl. No.: 12/979,219

(22) Filed: Dec. 27, 2010

(65) Prior Publication Data

US 2011/0187287 A1 Aug. 4, 2011

Related U.S. Application Data

(60) Provisional application No. 61/300,143, filed on Feb. 1, 2010.

(51) Int. Cl.
*G05F 1/00* (2006.01)

(52) U.S. Cl.
USPC ..... 315/291; 315/307; 315/247; 315/312; 315/185 S

(58) Field of Classification Search
USPC ..... 315/291, 307–326, 185 S, 247, 224, 277
See application file for complete search history.

(56) References Cited

U.S. PATENT DOCUMENTS 5,041,767 A 8/1991 Doroftei et al.
5,471,119 A 11/1995 Ranganath et al.
5,616,992 A 4/1997 Bildgen
5,925,990 A 7/1999 Crouse et al.
6,002,214 A 12/1999 Ribarich
6,072,282 A * 6/2000 Adamson ..... 315/276
6,072,283 A 6/2000 Hedrei et al.
6,088,249 A 7/2000 Adamson
6,137,240 A 10/2000 Bogdan
6,172,468 B1 1/2001 Hollander
6,259,215 B1 7/2001 Roman
6,326,740 B1 12/2001 Cheng et al.
6,337,544 B1 1/2002 Wang et al.
6,400,103 B1 6/2002 Adamson
6,501,235 B2 12/2002 Ortmeyer
6,504,313 B1 1/2003 Shen (Continued)

*Primary Examiner* — Tuyet Thi Vo
(74) *Attorney, Agent, or Firm* — Roeder & Broder LLP; James P. Broder

(57) ABSTRACT

A ballast (4) for providing power to a high intensity discharge lamp (8) includes a first sensor (32) and a control subsystem (16). The first sensor (32) generates a first signal indicative of a current level in the ballast (4). The control subsystem (16) computes a real time power level of the ballast (4) based at least upon the first signal, compares the computed real time power level to a specified power level, and modifies a frequency of operation of the ballast (4) in response to the comparison. The first sensor (32) can measure the current level at an output of the ballast (4). The ballast (4) can also include a second sensor (32) that generates a second signal indicative of a voltage output of the ballast (4). The control subsystem (16) can compute the real time power level of the ballast (4) based upon the second signal. The control subsystem (16) can be configured to read a lamp specified maximum power level, receive an input indicative of a dimming level, and/or compute the specified power level based upon the lamp specified maximum power level and the dimming level. The control subsystem (16) can incrementally decrease the frequency when the comparison indicates that the computed real time power level is less than the specified power level and/or incrementally increase the frequency when the comparison indicates that the computed real time power level is greater than the specified power level.

21 Claims, 5 Drawing Sheets

BALLAST BLOCK DIAGRAM

(56) References Cited

U.S. PATENT DOCUMENTS

| | | | |
|---|---|---|---|
| 6,580,275 | B2 | 6/2003 | Hui et al. |
| 6,628,093 | B2 | 9/2003 | Stevens |
| 6,650,067 | B1 | 11/2003 | Shloush et al. |
| 6,727,665 | B2 | 4/2004 | Yao |
| 6,759,813 | B2 | 7/2004 | Busse et al. |
| 6,771,029 | B2 | 8/2004 | Ribarich et al. |
| 6,853,154 | B2 | 2/2005 | Erhardt |
| 6,936,979 | B2 | 8/2005 | Lee et al. |
| 6,954,038 | B2 | 10/2005 | Ido et al. |
| 6,958,580 | B2 | 10/2005 | Kamoi et al. |
| 7,009,829 | B2 | 3/2006 | Lentz et al. |
| 7,019,468 | B2 | 3/2006 | Deurloo et al. |
| 7,067,987 | B2 | 6/2006 | Powers, Jr. et al. |
| 7,091,671 | B2 | 8/2006 | Deurloo et al. |
| 7,098,605 | B2 | 8/2006 | Oh |
| 7,109,668 | B2 | 9/2006 | Pogodayer et al. |
| 7,126,288 | B2 | 10/2006 | RIbarich et al. |
| 7,129,647 | B2 | 10/2006 | Dulanet et al. |
| 7,187,136 | B2 | 3/2007 | Fiorello |
| 7,239,094 | B2 | 7/2007 | Radzinski et al. |
| 7,312,586 | B2 | 12/2007 | Montante |
| 7,321,202 | B2 | 1/2008 | Chitta |
| 7,429,828 | B2 | 9/2008 | Cleland et al. |
| 7,429,830 | B2 | 9/2008 | Wessels et al. |
| RE40,843 | E | 7/2009 | Ribarich |
| 7,564,201 | B2 | 7/2009 | Steckling |
| 2008/0111497 | A1 | 5/2008 | Yanai et al. |
| 2009/0033238 | A1 | 2/2009 | Hollander |
| 2009/0200952 | A1 | 8/2009 | King |
| 2009/0206775 | A1 | 8/2009 | Green |
| 2009/0218959 | A1 | 9/2009 | Hollander et al. |
| 2011/0037410 | A1* | 2/2011 | Hsu et al. ..... 315/294 |

* cited by examiner

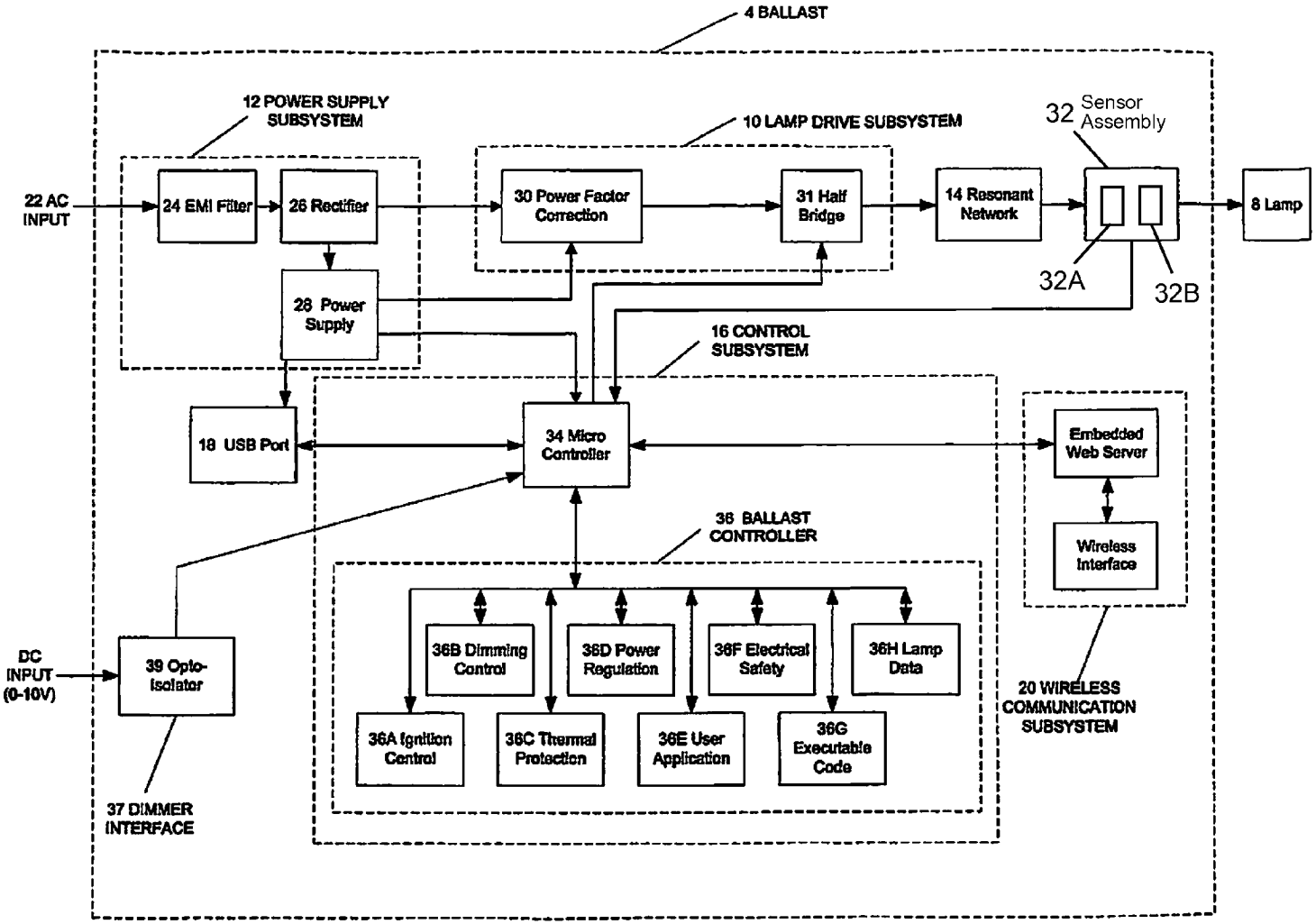
FIG. 2: BALLAST BLOCK DIAGRAM

BALLAST CONFIGURED TO COMPENSATE FOR LAMP CHARACTERISTIC CHANGES

RELATED APPLICATION

This application claims domestic priority under 35 U.S.C. §119(e) from U.S. Provisional Application Ser. No. 61/300,143 filed on Feb. 1, 2010, the entire contents of which are expressly incorporated herein by reference to the extent permitted.

BACKGROUND

High intensity discharge (HID) arc lamps are in wide use for general illumination. Applications include roadside street lamps, sports arena illumination, stadium illumination, auto dealership illumination, warehouse illumination, and other purposes requiring a high power of illumination with high efficiency. They tend to be mounted at fairly high elevations requiring maintenance crews to replace.

Ballasts used with these lamps historically are designed to optimize characteristics of power delivered to the lamps when the lamps are new having an initial impedance. As the lamps age, the characteristics of the lamps change. Typically the impedance of the lamp changes and the power levels and efficiency deteriorate. Ballasts have been designed to compensate for this impedance change, but there is still an efficiency loss in most ballasts.

SUMMARY

The present invention is directed toward a ballast for providing power to a high intensity discharge lamp. In one embodiment, the ballast includes a first sensor and a control subsystem. The first sensor generates a first signal indicative of a current level in the ballast. The control subsystem can (i) compute a real time power level of the ballast based at least upon the first signal, (ii) compare the computed real time power level to a specified power level, and/or (iii) modify a frequency of operation of the ballast in response to the comparison.

In one embodiment, the first sensor measures the current level at an output of the ballast. In another embodiment, the first sensor can include an inductive current sensor. In yet another embodiment, the ballast can also include a second sensor that generates a second signal indicative of a voltage output of the ballast. The control subsystem can compute the real time power level of the ballast based upon the second signal. Alternatively, the control subsystem can read the specified power level from a lookup table. In certain embodiments, the control subsystem can be configured to read a lamp specified maximum power level, receive an input indicative of a dimming level, and/or compute the specified power level based upon the lamp specified maximum power level and the dimming level.

In one embodiment, the control subsystem can incrementally decrease the frequency when the comparison indicates that the computed real time power level is less than the specified power level. Additionally, or in the alternative, the control subsystem can incrementally increase the frequency when the comparison indicates that the computed real time power level is greater than the specified power level. In one embodiment, the ballast can include a lamp drive subsystem that delivers a high frequency current to the lamp. In certain embodiments, the control subsystem can modify the high frequency current in response to the comparison.

The present invention is also directed toward a processor-based method of operating an electronic ballast coupled to a high intensity discharge lamp. In one embodiment, the method includes the steps of sensing an output current level in the ballast, computing a real time power level of the ballast based at least upon the output current level, comparing the computed real time power level with a specified power level for the discharge lamp, and modifying a frequency of operation of the ballast in response to the comparison.

BRIEF DESCRIPTION OF THE DRAWINGS

FIG. 2 is a block diagram illustrating one embodiment of the ballast;

DESCRIPTION

Figure 1:
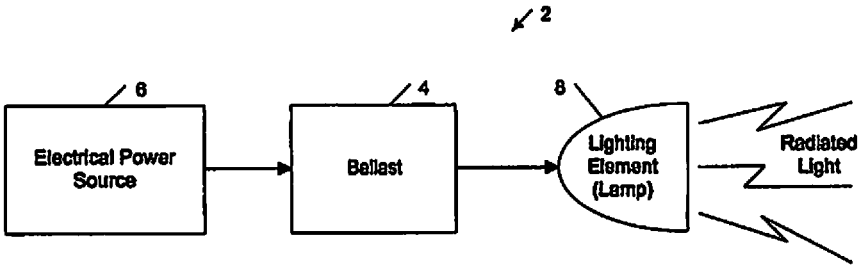
FIG. 1 is a block diagram illustrating one embodiment of a system having features of the present invention, including a power source, a ballast, and a lamp.

FIG. 1 is a block diagram of a system 2 having features of the present invention. In this embodiment, system 2 includes a ballast 4 configured to receive power from a power source 6 and deliver high frequency power signals to a lighting element 8. In one embodiment, power source 6 is a line power such as a power source delivering power to an elevated lamp such as a street lamp. In certain embodiments, lighting element 8 is a high intensity discharge lamp. In one embodiment, ballast 4 is configured to deliver current to lighting element 8 having a frequency of at least 50 kilohertz. In another embodiment, ballast 4 can deliver current having a frequency of at least 70 kilohertz, or in a range from 70 kilohertz to 100 kilohertz or at a frequency of at least 100 kilohertz. Still alternatively, ballast 4 can deliver current having a frequency of less than 50 kilohertz. In one particular embodiment, ballast 4 is configured to deliver less than 750 watts of electrical current-based power having a frequency of 100 kilohertz or greater. In one non-exclusive alternative embodiment, ballast 4 is configured to deliver more than 750 watts of electrical current-based power having a frequency between 70 and 100 kilohertz. In other non-exclusive embodiments, ballast 4 can deliver electrical current outside of the foregoing ranges with a frequency of less than 70 kilohertz, a frequency between 70 and 100 kilohertz, or a frequency of greater than 100 kilohertz.

FIG. 2 is a more detailed block diagram of one embodiment of the ballast 4 coupled to lighting element 8. Ballast 4 includes a lamp drive subsystem 10 configured to receive power from a power supply subsystem 12 and can deliver ballast-modified power to lighting element 8 through a resonant network 14. In the embodiment illustrated in FIG. 2, ballast 4 also includes a control subsystem 16 that receives inputs from an input/output (I/O) ports 18, 20 (shown as USB port 18 and wireless communication subsystem 20 in FIG. 2, as non-exclusive examples). The control subsystem 16 receives power from power supply subsystem 12, and can deliver control signals to lamp drive subsystem 10 in order to control an amount of power delivered from lamp drive subsystem 10 to lighting element 8.

In the embodiment illustrated in FIG. 2, power supply subsystem 12 receives power from an AC input 22 at EMI filter 24. EMI filter 24 is configured to receive power from AC power line source 22 and remove extraneous signals such as high frequency transient signals to provide a "cleaner" power signal to rectifier 26. Filtered power from filter 24 is delivered to rectifier 26 that provides DC power to low power supply 28 and PFC (power factor correction) circuitry 30. PFC circuitry 30 adjusts the power factor of the drive signal before delivering the power to half bridge 31. Under control of control subsystem 16, half bridge 31 delivers high frequency power to lighting element 8 via resonant network 14.

In the embodiment illustrated in FIG. 2, between resonant network 14 and lighting element 8 is a sensor assembly 32 including one or more sensors, e.g., a first sensor 32A and a second sensor 32B. In one embodiment, the sensor assembly 32 can include a current sensor as the first sensor 32A. The current sensor 32A can be an inductive current sensor configured to deliver a signal to control subsystem 16 that is indicative of a current level being generated by lamp drive subsystem 10. Additionally, or in the alternative, the sensor assembly 32 can include a voltage sensor as the second sensor 32B, which is positioned in ballast 4 and is configured to deliver a signal to control subsystem 16 that is indicative of a voltage that is output by lamp drive subsystem 10.

In certain embodiments, control subsystem 16 includes a microcontroller 34 that is coupled to I/O ports 18, 20, half bridge 31, and ballast controller 36. Microcontroller 34 can be configured to serve as an interface between ballast controller 34 and I/O ports 18, 20 and/or as an interface between ballast controller 36 and half bridge 31.

In certain embodiments, ballast controller 36 can store computer code defining a plurality of different software modules 36A-H providing functions including that of control and reporting operation of ballast 4. In one embodiment, software modules 36A-H are accessible by a client device (not shown) through I/O ports 18, 20. Ballast controller 36 is configured to execute the computer code so as to report information to I/O ports 18, 20, to receive inputs from sensor assembly 32, and/or to control lamp drive subsystem 10. Software modules can include one or more of ignition control module 36A, dimming control module 36B, thermal protection module 36C, power regulation module 36D, user application module 36E, electrical safety module 36F, executable code module 36G, and lamp data module 36H, as non-exclusive examples. As modules are discussed herein, the term "module" refers to the software code itself or to ballast controller 36 executing the software along with associated data stored in memory registers.

Lamp data module 36H can be configured to store data related to lighting element 8. When lighting element 8 is installed, ballast 4 may read data from the lighting element 8 (that may be stored on lighting element 8) that pertains to lighting element characteristics such as the proper operating voltage, a power rating, etc. Alternatively, a client device (not shown) may communicate this information to controller 36 using I/O ports 18, 20. From this information, lamp data module 36H determines and stores a maximum power rating for lighting element 8 that is the power to be applied to lighting element 8 for full or maximum power.

Lamp dimming control module 36B can be configured to receive a dimming level for lighting element 8 from a dimmer interface 37. In one embodiment, dimmer interface 37 acts through opto-isolator 39 that receives a voltage from 0 to 10 volts depending upon the dimming set point for which 0 volts corresponds to no dimming and 10 volts corresponds to 50% dimming. The dimming, level is a percentage reduction of the maximum power which lamp drive subsystem 10 is to deliver to lighting element 8. From this dimming level, module 36B is configured to compute a specified power level to be delivered to lighting element 8. The specified power level may be the maximum power level or it may be a fraction of the maximum power level pursuant to the input dimming level. In an alternative embodiment, the voltage range can be different than 0 to 10 volts.

Power regulation module 36D can be configured to control power delivered by lamp drive subsystem 10 to lighting element 8. Power regulation module 36D is configured to receive inputs such as those from current sensor 32A and voltage sensor 32B that monitor output current and voltage of lamp drive subsystem 10 during operation of ballast 4. From the current and voltage information inputs the power regulation module 36D can compute a real time power level of power being delivered by lamp drive subsystem to lighting element 8.

Power regulation module 36D can be further configured to compare the computed real time power level actually delivered to the specified power level that is desired to be delivered to lighting element 8. In response to the comparison, power regulation module 34D is configured to control half bridge 31 in order to modulate the frequency of power being delivered from half bridge 31 to lighting element 8. Increasing the frequency delivered will lower the power level delivered. Conversely, decreasing the frequency increases the power level delivered. Therefore, in this embodiment, power regulation module 34D is configured to control half bridge 31 to reduce the frequency of power delivered to lighting element 8 in response to a comparison indicating that the real time power level is less than the specified power level. In one embodiment, power regulation module 34D can be configured to control half bridge 31 to increase the frequency of power delivered to lighting element 8 in response to a comparison indicating that the real time power level is greater than the specified power level.

Figure 3:
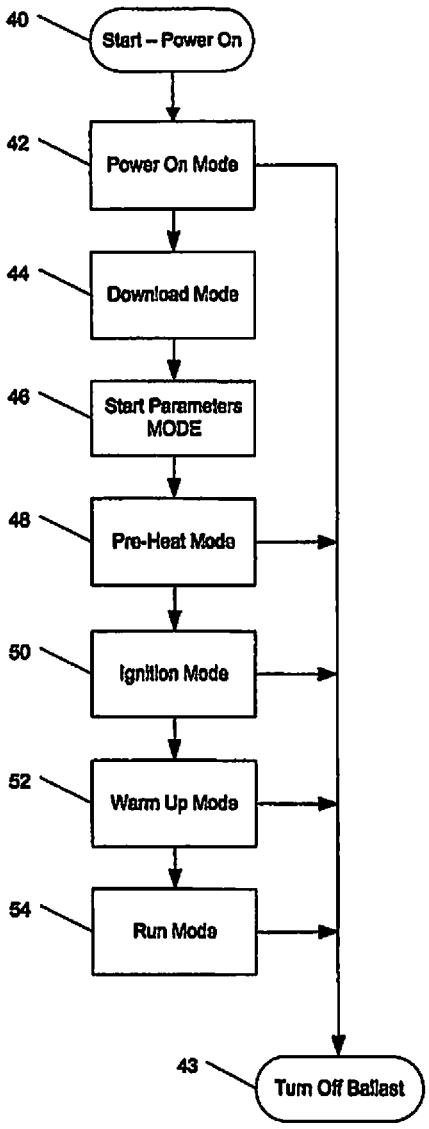
FIG. 3 is a flow chart illustrating one embodiment of a method showing start up and operation procedures for the ballast.

FIG. 3 is a flow chart depicting one embodiment of a start up and operation procedure for ballast 4. Prior to the method according to FIG. 3, the lamp is turned off. At step 40, the lamp operation sequence is started. At step 42, a power on fault check process takes place as later discussed with respect to FIG. 5. If the ballast 4 fails to pass a step of the fault check, the ballast 4 is turned off or not ignited at step 43. Otherwise a download procedure takes place over one or more I/O ports 18, 20 (FIG. 2) at step 44. At step 44, ballast controller 36 may receive new parameters, software updates, or new executable code, as non-exclusive examples.

At step 46, the ballast controller 36 initializes processor parameters. At this point operating parameters for ballast 4 such as the specified power level may be loaded into a register. At step 46, this may be a power rating for the lighting element or it may be a computed specified power level based upon the lighting element power rating and a dimmer setting. At step 48, the lighting element goes through a pre-heat mode before the ignition mode at step 50. The lighting element is then ignited at step 50 and allowed to warm up at step 52. The now warmed up lighting element is allowed to run at step 54. It is understood that in various alternative embodiments, certain steps illustrated and described relative to FIG. 3 can be omitted, or other steps can be added.

Figure 4A:
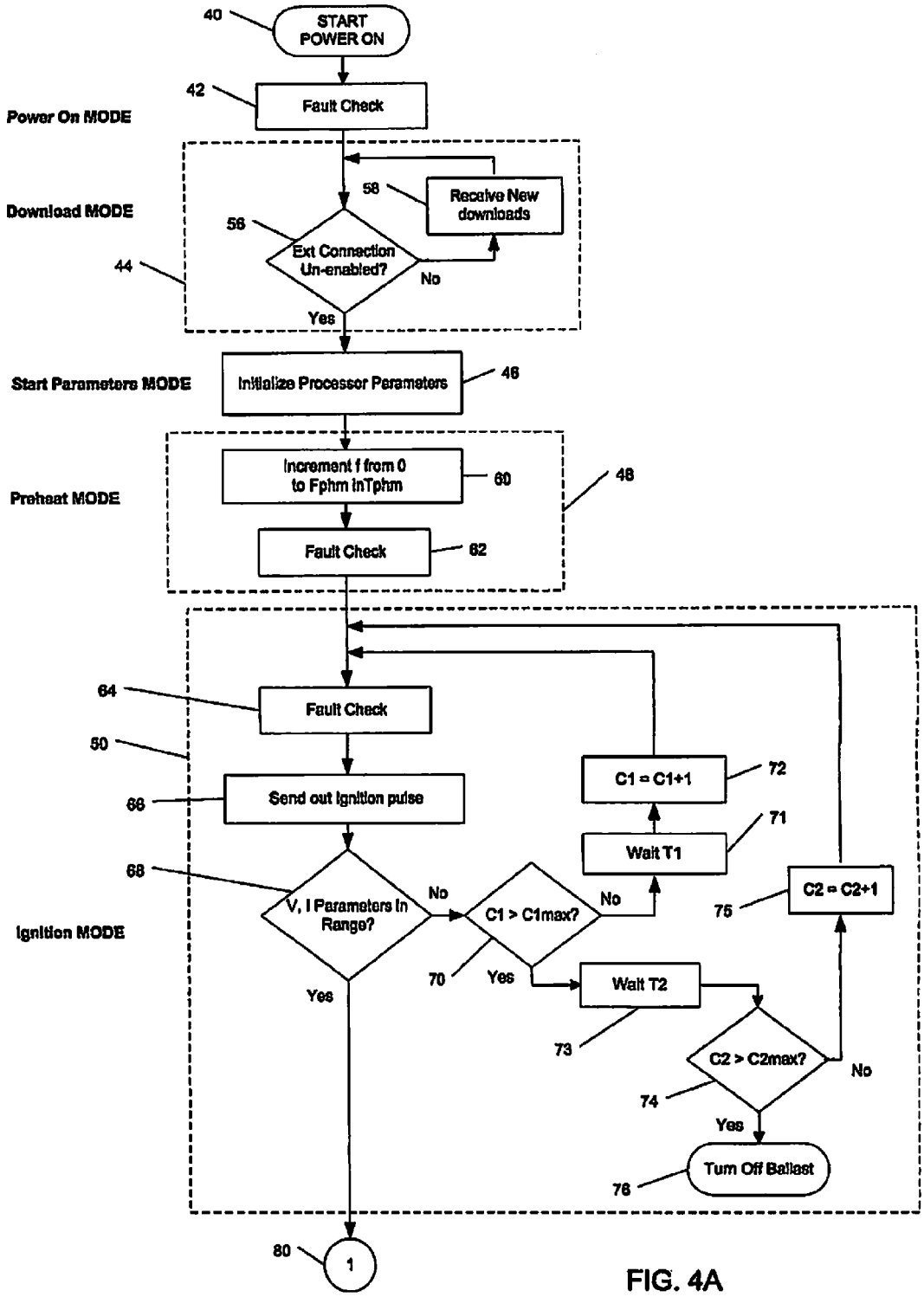
FIGS. 4A and 4B illustrate a flow chart depicting another embodiment of a method including start up and operation procedures for the ballast.
Figure 4B:
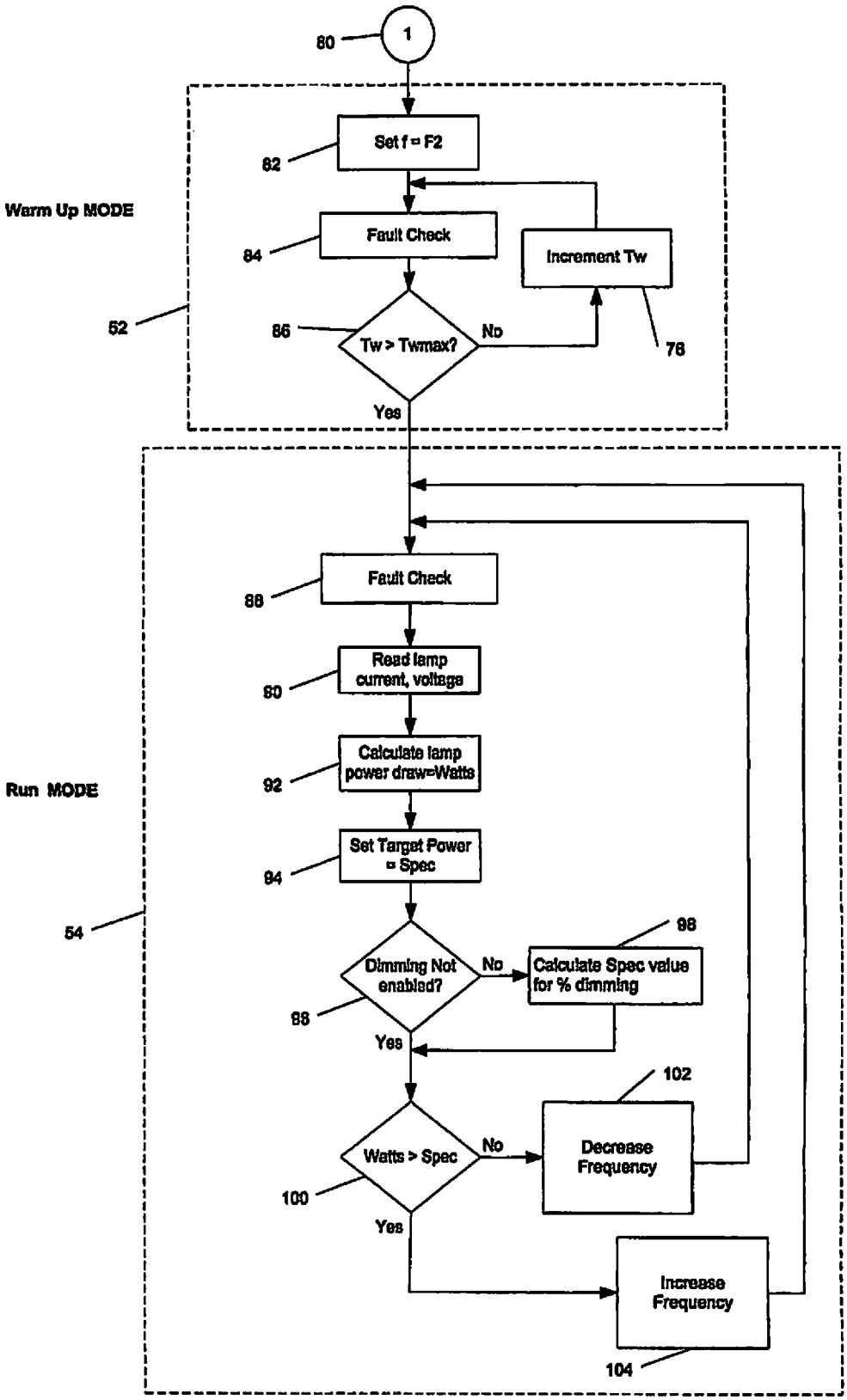

FIGS. 4A and 4B are flow charts in sequence depicting one embodiment of the start up and operation of ballast 4 in more detail relative to FIG. 3. Like element numbers indicate like processes relative to FIG. 3 and description of certain processes illustrated in FIGS. 4A and 4B may be omitted if they have previously been discussed herein.

In this embodiment, at step 44, the download mode takes place. Downloading at step 44 can include ballast controller 36 receiving information from a client (not shown) using I/O ports 18, 20, such as wired link 18 or wireless link 20. At step 56, ballast controller 36 can run a check to see if a client is connected through an I/O port 18, 20 and if inputs or a download is to take place. If so, downloaded software updates, executable code, and/or control parameters are received at step 58. If not, then receiving downloaded software updates, executable code, and/or control parameters can be omitted.

At step 46, the software and operating parameters are initialized for execution. At step 48, the lighting element 8 is preheated. This can include, for example, incrementing an applied frequency of power from half bridge 31 to lighting element 8 from a zero frequency level to a frequency for preheat mode according to step 60, and/or performing a fault check at step 62.

After the lighting element 8 is preheated, it is ignited at step 50. At step 64, another fault check can occur. An ignition pulse can then be applied at step 66. At step 68, sensors (including first sensor 32A and/or second sensor 32B illustrated in FIG. 2) can measure current and/or voltage output from half bridge 31. If the current and/or voltage are not within an acceptable level, a first counter value C1 can be compared with a first upper limit C1 max at step 70. If the counter C1 is no greater than C1 max then a first wait time T1 is elapsed at step 71, and the counter C1 can be incremented at step 72 before the fault check 64 and ignition attempt 66 is repeated. In one embodiment, if the ignition attempts 66 continue to fail, then the nested counting process depicted at step 50 can continue as C1 exceeds C1 max, and the second loop steps of 73, 74, and 75 take place in a manner substantially similar to the first loop steps of 70, 71 and 72. If the number of attempts has exceeded C2max then the ballast can be turned off at step 76. However, if one of the ignition attempts is successful, then the process can pass to FIG. 4B at step 80.

At step 52, the now-ignited lamp is allowed to warm up. At step 82, the frequency applied by half bridge 31 can be set to a value F2. At step 84, a fault check is performed. At step 86, if a time counter is less than a value TWMAX, then the time counter can be incremented and the process can loop back to the fault check at step 84. When the time counter exceeds its maximum value, the warm up process is complete and the run mode at step 54 takes place.

In one embodiment, at step 88, a fault check can again be performed. Next, at step 90, information from sensors (including current sensor 32A and/or voltage sensor 32B illustrated in FIG. 2) can be received by control subsystem 16 that is indicative of the voltage and/or current being output by half bridge 31. At step 92, control subsystem 16 can perform a calculation of real time power level based upon the product of the current and voltage, for example. At step 94, a specified power level can initially be set based upon a specification for lighting element 8. At step 96, it is determined whether dimming is enabled. If not, the specified power level can be based entirely upon the lamp specification. However, if dimming is enabled, the specified power level can be adjusted according to the dimming level at step 98.

At step 100, control subsystem 16 (illustrated in FIG. 2) compares the specified power level (which may or may not be adjusted for dimming according to steps 96 and/or 98) to the real time power level calculated at step 92. If the real time power level is below the specified power level, then the operating frequency of the half bridge 31 can be lowered incrementally at step 102. If, on the other hand, the real time power level is above the specified power level then the operating frequency can be increased incrementally at step 104. In either case of steps 102 or 104, the process can loop back to fault check 88. It is understood that in various alternative embodiments, certain steps illustrated and described relative to FIGS. 4A and 4B can be omitted, or other steps can be added, and that the embodiment shown and described relative to FIGS. 4A and 4B is provided as one representative example and is not intended to be limiting in any manner.

In one embodiment, the frequency is incrementally decreased (such as in approximately 1 KHz increments, as one non-exclusive example) at step 102, and/or incrementally increased (such as in approximately 1 KHz increments, as one non-exclusive example) at step 104. In one embodiment, the ballast and lamp can have a maximum output of approximately 400 watts when the frequency applied by the ballast is approximately 100 KHz and can have a reduced output of approximately 200 watts when the frequency applied by the ballast is approximately 180 KHz. In this embodiment, the 200 watt level would refer to approximately 50 percent dimming when opto-isolator is receiving an input voltage of approximately 10 volts. The 400 watt level would refer to approximately zero percent dimming when the opto-isolator is receiving an input of approximately zero volts.

In non-exclusive alternative embodiments, maximum wattages can be envisioned below 400 watts, in the range of 400-1000 watts, or above 1000 watts, for example. Further still, operating frequencies generally tend to be lower for the higher wattage ballast/lamp systems and may be more like 70 KHz or less for some higher wattage systems. However, frequencies may be above 180 KHz for lower wattage lamp/ballast systems. The step sizes according to steps 102 and 104 may also vary. For example, step sizes of more or less than 1 KHz can be used depending on a degree of sensitivity that is preferred in establishing an optimal operating frequency level. While the input for the dimming opto-isolator is depicted to use a voltage of 0 to 10 volts, other ranges of voltage can be utilized. Moreover, the dimmer interface may be current-driven rather than voltage driven. Alternatively, the dimming may be entered in a completely different way based completely upon signal received through I/O ports such as USB link 18 or wireless link 20, or based computer code defining a dimming level versus time. In one embodiment, during steps 42-54 described with respect to FIGS. 3, 4A, and 4B, fault checks can be interspersed in order to assure safe and reliable operation of lighting element 8.

Figure 5:
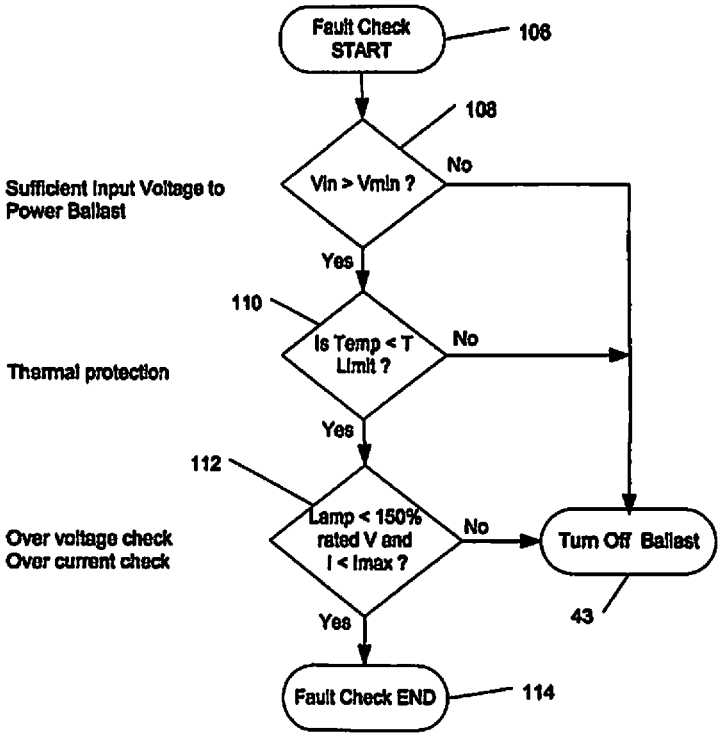
FIG. 5 is a flow chart illustrating one embodiment of a fault check procedure that is utilized with the present invention.

One embodiment of a fault check that may be used in any or all of the fault checks indicated is depicted in FIG. 5. At step 106, a fault check is initiated. At step 108, the input voltage to the ballast is checked to determine if a minimum voltage level is being received. At step 110, a ballast temperature is checked to determine if it is below a safety limit. At step 112, the voltage and current of the lamp are checked to make sure they are below safety limits. If the result of all these checks is in the affirmative, then the fault check ends at step 114. Otherwise, the ballast is turned off at step 43. It is understood that in various alternative embodiments, certain steps illustrated and described relative to FIG. 5 can be omitted, or other steps not shown and described can be added, and that the embodiment shown and described relative to FIG. 5 is provided as one representative example and is not intended to be limiting in any manner.

While the particular system and methods as shown and disclosed herein are fully capable of obtaining the objects and providing the advantages herein before stated, it is to be understood that they are merely illustrative of the presently preferred embodiments of the invention and that no limitations are intended to the details of the methods, construction or design herein shown and described.

What is claimed is:

1. A ballast for providing power to a high intensity discharge lamp, the ballast comprising:

a first sensor that generates a first signal indicative of a level of current in the ballast prior to the current being delivered to the lamp; and a control subsystem that (i) computes a real time power level of the ballast based at least upon the first signal, (ii) compares the computed real time power level to a specified power level, and (iii) modifies a frequency of operation of the ballast in response to the comparison.

2. The ballast of claim 1 wherein the first sensor measures the level of current at an output of the ballast.

3. The ballast of claim 1 wherein the first sensor includes an inductive current sensor.

4. The ballast of claim 1 further comprising a second sensor that generates a second signal indicative of a voltage output of the ballast, wherein the control subsystem computes the real time power level of the ballast based upon the second signal.

5. The ballast of claim 1 wherein the control subsystem reads the specified power level from a lookup table.

6. The ballast of claim 1 wherein the control subsystem is further configured to:

(1) read a lamp specified maximum power level;

(2) receive an input indicative of a dimming level; and (3) compute the specified power level based upon the lamp specified maximum power level and the dimming level.

7. The ballast of claim 1 wherein the control subsystem incrementally decreases the frequency when the comparison indicates that the computed real time power level is less than the specified power level.

8. The ballast of claim 1 further comprising a lamp drive subsystem that delivers a high frequency current to the lamp, wherein the control subsystem modifies the high frequency current in response to the comparison.

9. The ballast of claim 1 wherein the control subsystem incrementally increases the frequency when the comparison indicates that the computed real time power level is greater than the specified power level.

10. The ballast of claim 9 wherein the control subsystem incrementally decreases the frequency when the comparison indicates that the computed real time power level is less than the specified power level.

11. A processor-based method of operating an electronic ballast coupled to a high intensity discharge lamp, the method comprising the steps of:

sensing an output level of current in the ballast prior to the current being delivered to the lamp;

computing a real time power level of the ballast based at least upon the output level of current;

comparing the computed real time power level with a specified power level for the discharge lamp; and modifying a frequency of operation of the ballast in response to the comparison.

12. The method of claim 11 wherein the step of sensing includes inductively sensing the output level of current.

13. The method of claim 11 further comprising the step of measuring an output voltage level of the ballast, wherein computing the real time power level is based upon the output level of current and the output voltage level.

14. The method of claim 11 further comprising the step of reading the specified power level from a control subsystem within the ballast.

15. The method of claim 11 further comprising the step of computing the specified power level based upon a lamp specification and a dimming level of the discharge lamp.

16. The method of claim 11 wherein the step of modifying the frequency of operation of the ballast in response to the comparison includes:

(1) decreasing the frequency of operation when the computed real time power level is less than the specified power level; and (2) increasing the frequency of operation when the computed real time power level is greater than the specified power level.

17. A ballast for providing power to a high intensity discharge lamp, the ballast comprising:

a lamp drive subsystem that delivers a high frequency current to the lamp;

a sensor that generates a current signal based upon a magnitude of the current prior to the current being delivered to the lamp; and a control subsystem that (i) stores and operates software instructions, (ii) operates the lamp drive subsystem pursuant to the software instructions and a specified power level for the lamp, (iii) computes a real time power level of the lamp based at least upon the current signal, (iv) compares the computed real time power level to the specified power level; and (v) modifies the high frequency current in response to the comparison.

18. The ballast of claim 17 wherein the control subsystem (i) stores a manufacturer specified power level for the lamp, and (ii) computes the specified power level based upon a manufacturer specified power level and a dimming level of the lamp.

19. The ballast of claim 17 wherein the control subsystem stores a plurality of software modules that each controls a different function related to controlling the lamp drive subsystem.

20. The ballast of claim 17 wherein the control subsystem (i) decreases the delivered frequency when the computed real time power level is below the specified power level, and (ii) increases the delivered frequency when the computed real time power level is above the specified power level.

21. The ballast of claim 17 wherein the frequency of the high frequency current is at least approximately 70 kilohertz.

* * * * *